US010109961B1

(12) United States Patent
Lin

(10) Patent No.: US 10,109,961 B1
(45) Date of Patent: Oct. 23, 2018

(54) PLUG STRUCTURE

(71) Applicant: Chia-Hua Lin, New Taipei (TW)

(72) Inventor: Chia-Hua Lin, New Taipei (TW)

( * ) Notice: Subject to any disclaimer, the term of this patent is extended or adjusted under 35 U.S.C. 154(b) by 0 days.

(21) Appl. No.: 15/782,295

(22) Filed: Oct. 12, 2017

(51) Int. Cl.
*H01R 13/68* (2011.01)
*H01R 31/02* (2006.01)
*H01R 13/688* (2011.01)
*H01R 13/46* (2006.01)

(52) U.S. Cl.
CPC ..... *H01R 13/688* (2013.01); *H01R 13/46* (2013.01)

(58) Field of Classification Search
CPC .... H01R 13/68; H01R 31/02; H01R 13/5816; H01R 13/5812; H01R 13/58; H01R 2103/00; H01R 13/684; H01R 13/688
USPC ..... 439/620.29–620.32, 460
See application file for complete search history.

(56) References Cited

U.S. PATENT DOCUMENTS 4,647,127 A * 3/1987 Weingartner ..... H01R 13/28 439/289
4,652,073 A * 3/1987 Shaver ..... H01R 13/5837 439/460
5,083,938 A * 1/1992 Poliak ..... H01R 13/58 439/460
5,637,017 A * 6/1997 Hsu ..... H01R 13/68 337/198
5,643,012 A * 7/1997 Mai ..... H01R 13/68 200/51 R
5,853,301 A * 12/1998 Wang ..... H01R 13/68 439/620.29
5,906,515 A * 5/1999 Lin ..... H01R 13/68 337/197
5,984,730 A * 11/1999 Lu ..... H01R 13/68 439/620.3
6,648,674 B1 * 11/2003 Dobler ..... H01R 13/5841 439/455
7,086,897 B2 * 8/2006 Montena ..... H01R 9/0524 439/460
8,672,705 B2 * 3/2014 Schneider ..... G02B 6/3887 439/460
9,507,102 B2 * 11/2016 Conner ..... G02B 6/3887
2003/0013345 A1 * 1/2003 Yen ..... H01R 13/585 439/620.3
2003/0139097 A1 * 7/2003 Liu ..... H01R 13/521 439/620.3
2003/0207618 A1 * 11/2003 Chen ..... H01R 4/2433 439/620.32

(Continued)

*Primary Examiner* — Gary Paumen
(74) *Attorney, Agent, or Firm* — WPAT, PC

(57) ABSTRACT

A plug structure comprises a seat body, an electric power line and a housing, wherein the front end of the seat body includes at least two conductive plates, the inside of the seat body has a main fuse electrically connected to the conduct plate and a backup fuse, and the electric power line can be set up at the rear end of the seat body and clipped by the contraction plates respectively installed on the two sides of the rear end of the seat body; therefore, when the housing is sleeve installed towards the seat body from the electric power line, the contraction plate squeezes the electric power line due to the structure at the rear end of the housing such that the zigzag tooth-wise pattern configured on the inner surface of the contraction plate can tightly press upon the surface of the electric power line so the electric power line may not be easily pulled out from the rear end of the seat body.

4 Claims, 8 Drawing Sheets

(56) References Cited

U.S. PATENT DOCUMENTS

| | | | | |
|---|---|---|---|---|
| 2005/0250361 | A1* | 11/2005 | Yen | H01R 13/68<br>439/140 |
| 2009/0197470 | A1* | 8/2009 | Ding | H01R 13/68<br>439/620.3 |
| 2016/0047994 | A1* | 2/2016 | Conner | G02B 6/3887<br>385/87 |

* cited by examiner

PLUG STRUCTURE

BACKGROUND OF THE INVENTION

1. Field of the Invention

The present invention generally relates to a plug structure; in particular, it relates to a plug structure enabling handy occlusive hole-sealing operations.

2. Description of Related Art

At present, household appliances use an electric power plug to insert into a power socket in order to draw electricity for operations, and such applications have already comprehensively become a part of daily family lives. It is generally known that household electric power may be provided in 110V or 220V in different countries but typical electric power plugs are not configured with any protection structures, which may occasionally cause terrible consequences due to accidents initiated by imprudent utilizations of power-connected electric appliances, or sometimes lethal electric shocks may even occur; therefore, seeing that electric current overflow may potentially damage the electric appliances or lead to dangerous wire fire events, it becomes an important issue to figure out how to combine the power plug with some sort of security unit so as to restrain the electric load within a certain range.

Also, with regards to the structure of extended connection electric power plugs, this kind of electric power plugs are constructed in a sleeve assemblage or combination approach, but the electric power line in the electric power plug is jointed by means of pressure-connection installations, and in case of poor pressure-connection installations, it is possible to encounter the danger of power line fall-off thus resulting in electric power short circuit events; besides, after long terms uses, without the aforementioned protection measures, the pressure-connection part on the electric power line may become loose or deviated because of swinging or dragging by external force, thus causing power disconnection or leakage issues, so the electric power plugs set up in this fashion may lead to serious problems.

Accordingly, the present invention would be an optimal solution if it is possible to design an electric power plug internally installed with a replaceable fuse and further configured with a tight pressure mechanism therein for the connection to an electric power line such that the electric power line can not be easily pulled out from the rear end of the electric power plug.

SUMMARY OF THE INVENTION

The plug structure according to the present invention comprises: a seat body, in which two slot-shaped plug connection holes are formed at the front end thereof, and a first line-guiding groove, a fuse backup groove and a second line-guiding groove are formed by at least two separation boards at the rear side the two plug connection holes, wherein the rear side of the seat body backwardly and slantingly extends out two opposite guiding plates, with the front end of each guiding plate retracting and further extending out a contraction plate, and the front end on the outer surface of the contraction plate protrudes towards one side to set up a blocker, a recess is formed at the outer surface of the contraction plate between the front retracted part of the guiding plate and the blocker, and a zigzag tooth-wise pattern in configured on the inner surface of the contraction plate; a backup fuse, placed within the first line-guiding groove; a central line conductive plate, inserted into the plug connection hole in front of the first line-guiding groove; a fire line conductive plate, inserted into the plug connection hole in front of the second line-guiding groove, in which the rear end of the fire line conductive plate is electrically connected to one end of the main fuse; an electric power line, allowed to penetrate and be fixed between the two opposite guiding plates, in which the electric power line can extend out power cords and respectively penetrate through the first line-guiding groove and the second line-guiding groove thereby respectively electrically connecting to the tail end of the central line conductive plate and the other end of the main fuse; a housing, internally including a hollow accommodation space, in which the front end and the top end of the housing respectively have a front end opening and a top end opening communicatively connected to the hollow accommodation space, the inner rim of the top end opening has a slide track, and the inner rim of the top end opening can be further combined with a cover board having a slide block which can slide forwards and backwards along the slide track in the inner rim of the top end opening; besides, the rear end of the housing includes a retracted opening portion having a rear end opening, the inner side of the retracted opening portion has a guiding plane, and the front end of the guiding plane includes at least an abutting mass protruding from the inner side of the retracted opening portion; and wherein the housing can be placed in sleeve towards the seat body from the electric power line, the blocker of the contraction plate slides towards the rear end opening along the guiding plane of the retracted opening portion, and, after the contraction plate penetrating out from the rear end opening, the blocker of the contraction plate can be fixedly positioned inside the recess of the guiding plate and the contraction plate on the two sides of the electric power line can be squeezed and pressed inwards, thereby allowing the zigzag tooth-wise patterns on the inner surfaces of the two contraction plates to be tightly pressed on the surface of the electric power line.

More specifically, the top end opening of the aforementioned housing corresponds to the locations of the fuse backup groove and the second line-guiding groove.

More specifically, the electric power cord in the aforementioned electric power line is electrically connected to the main fuse via a conductive copper plate.

More specifically, the bottom of the aforementioned seat body is further configured with a plug connection end, and a ground line conductive terminal can be insertion installed on the plug connection end such that the electric power cord can also extend out from the electric power line for electric connections to the ground line conductive terminal.

DETAILED DESCRIPTION OF THE PREFERRED EMBODIMENTS

Figure 1A:
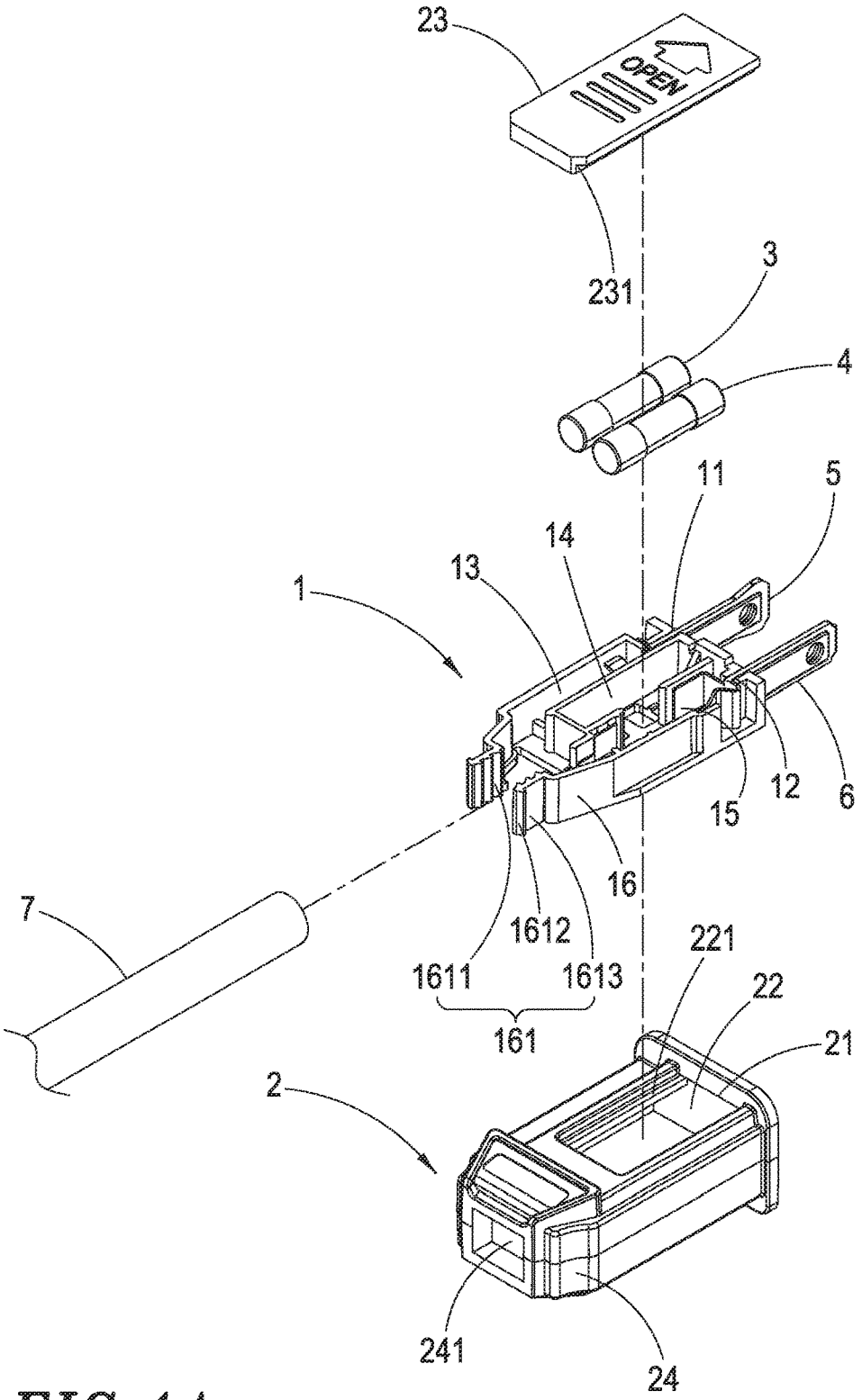
FIG. 1A shows a stereo structural disassembly view for a first embodiment of the plug structure according to the present invention.
Figure 1B:
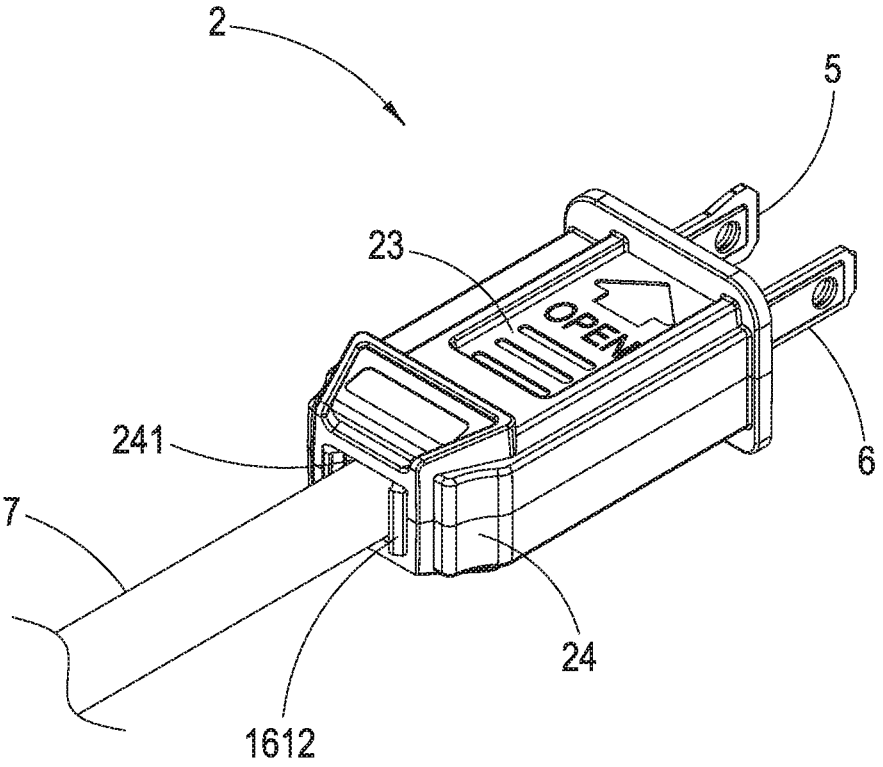
FIG. 1B shows a stereo structural assembly view for the first embodiment of the plug structure according to the present invention.
Figure 1C:
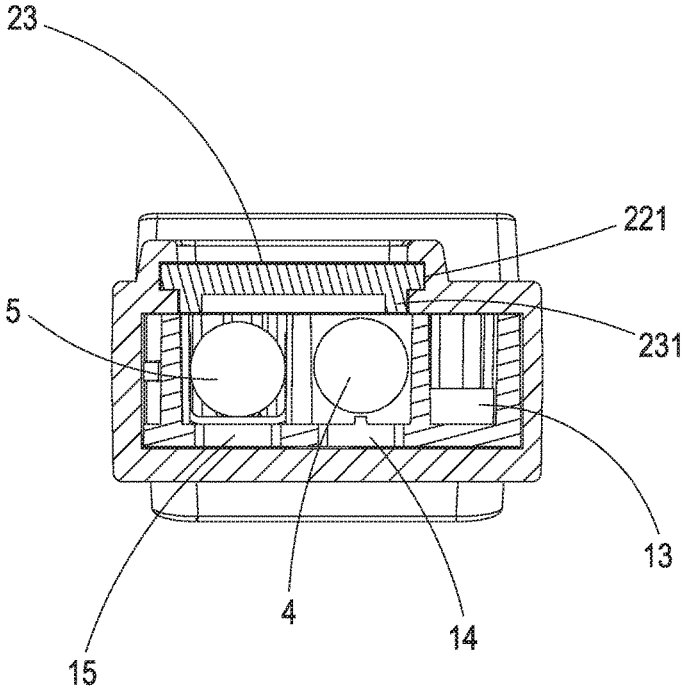
FIG. 1C shows a cross-sectioned structural view for the first embodiment of the plug structure according to the present invention.
Figure 1D:
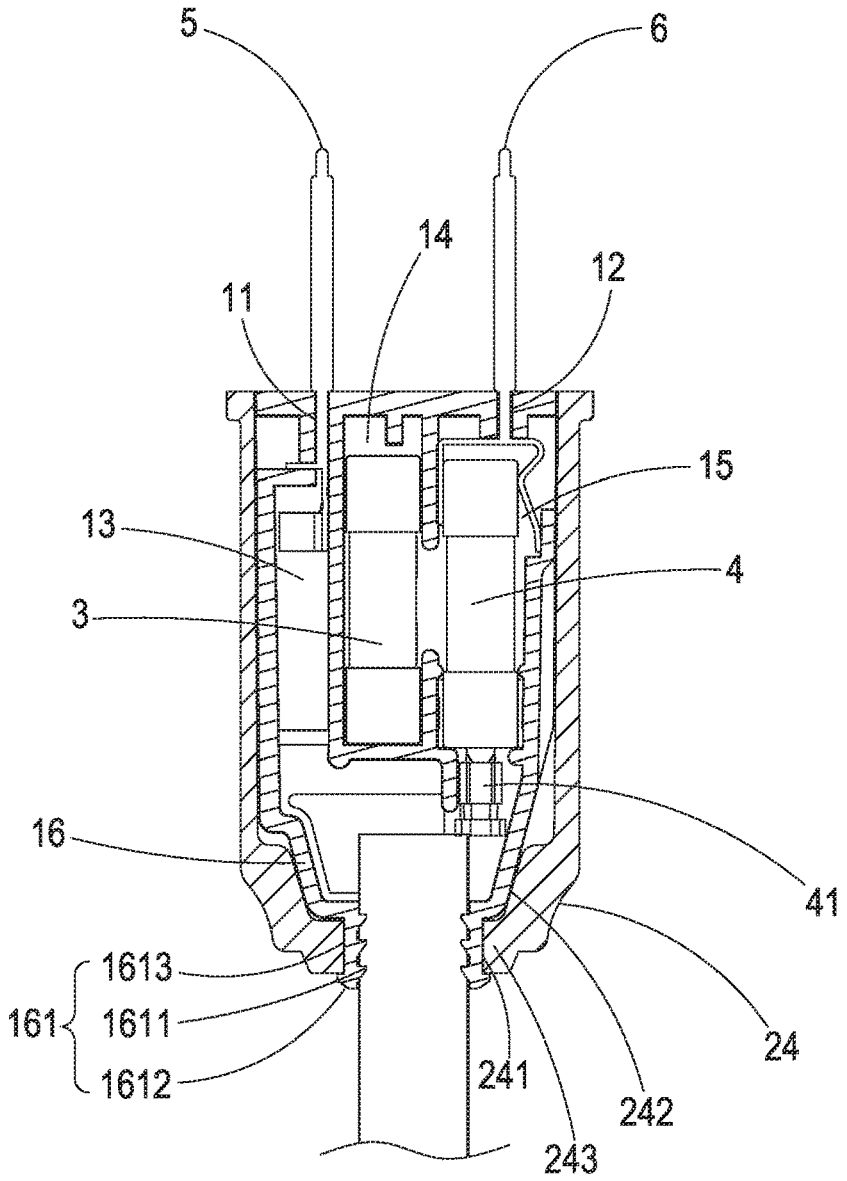
FIG. 1D shows a cross-sectioned structural view for the first embodiment of the plug structure according to the present invention.

Other technical contents, aspects and effects in relation to the present invention can be clearly appreciated through the detailed descriptions concerning the preferred embodiments of the present invention in conjunction with the appended drawings.

Refer initially to FIGS. 1A-1D, wherein a stereo structural disassembly view, a stereo structural assembly view and a cross-sectioned structural view of the plug structure according to the present invention are respectively shown. As shown in the Figures, the illustrated plug structure comprises a seat body 1, a housing 2, a backup fuse 3, a main fuse 4, a central line conductive plate 5, a fire line conductive plate 6 as well as an electric power line 7.

Herein the front end of the seat body 1 includes two slot-shaped plug connection holes 11, 12, in which the two plug connection holes 11, 12 are respectively insertion installed with a fire line conductive plate 5 and a central line conductive plate 6, while the rear sides of the plug connection holes 11, 12 are respectively configured with a first line-guiding groove 13, a fuse backup groove 14 and a second line-guiding groove 15 by means of at least two separation boards; also, the backup fuse 3 is loaded in the first line-guiding groove 13, the main fuse is loaded in the second line-guiding groove 15, and the rear end of the fire line conductive plate 5 is electrically connected to one end of the main fuse 4.

Also, two opposite guiding plates 16 extend obliquely backwards from the rear end of the seat body 1, with the front side of each guiding plate 16 being able to retract and further extend out a contraction plate 161, wherein a blocker 1612 protrudes towards one side at the front end on the outer surface of the contraction plate 161, a recess 1613 is created on the outer surface of the contraction plate between the retracted portion at the front side of the guiding plate 161 and the blocker 1612, and a zigzag tooth-wise pattern 1611 is formed on the inner surface of the contraction plate.

Herein the electric power line 7 is allowed to penetrate and be fixed between the two opposite guiding plates 16, in which the electric power line 7 can extend out power cords and respectively penetrate through the first line-guiding groove 13 and the second line-guiding groove 15 thereby respectively electrically connecting to the tail end of the central line conductive plate 6 and the other end of the main fuse 4.

Meanwhile, the housing 2 internally includes a hollow accommodation space, the front end and the top end of the housing respectively have a front end opening 21 and a top end opening 22 communicatively connected to the hollow accommodation space, the inner rim of the top end opening 22 has a slide track, and the inner rim of the top end opening 22 can be further combined with a cover board 23 having a slide block 231 which can slide forwards and backwards along the slide track 221 in the inner rim of the top end opening 22.

Besides, the rear end of the housing 2 includes a retracted opening portion 24 having a rear end opening 241, the inner side of the retracted opening portion 24 has a guiding plane 242, and the front end of the guiding plane 242 includes at least an abutting mass 243 protruding from the inner side of the retracted opening portion 24.

Therefore, wherein the housing 2 is placed in sleeve towards the seat body 1 from the electric power line, the blocker 1612 of the contraction plate 161 slides towards the rear end opening 241 along the guiding plane 242 of the retracted opening portion 24, and, after the contraction plate 161 penetrating out from the rear end opening 241, the blocker 1612 of the contraction plate 161 can be fixedly positioned inside the recess 1613 of the guiding plate 16; thus, with this in-out collaborative joint, the contraction plate 161 on the two sides of the electric power line 7 can be squeezed and pressed inwards, thereby allowing the zigzag tooth-wise patterns 1611 on the inner surfaces of the two contraction plates 161 to be tightly pressed on the surface of the electric power line 7.

Figure 2:
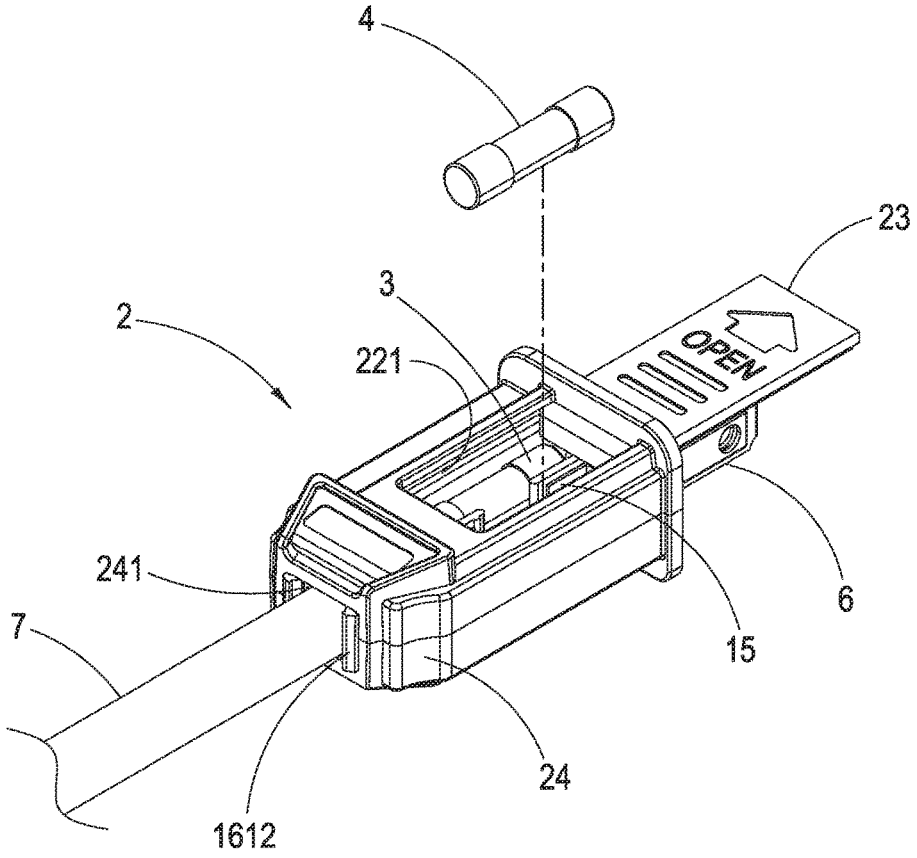
FIG. 2 shows a view for the fuse replacement in the plug structure according to the present invention.

Furthermore, the top end opening 22 of the housing 2 corresponds to the locations of the fuse backup groove 14 and the second line-guiding groove 15. Consequently, as shown in FIG. 2, when the main fuse 4 is melted and broken, it is possible to push off the cover board 23 to expose the fuse backup groove 14 and the second line-guiding groove 15, and then remove the broken main fuse 4 and take out the backup fuse 3 placed on the fuse backup groove 14 to load it into the second line-guiding groove 15; in this way, the user can conveniently replace the fuse directly when the fuse is melted and damaged with no need to purchase extra fuse for replacement.

Figure 3A:
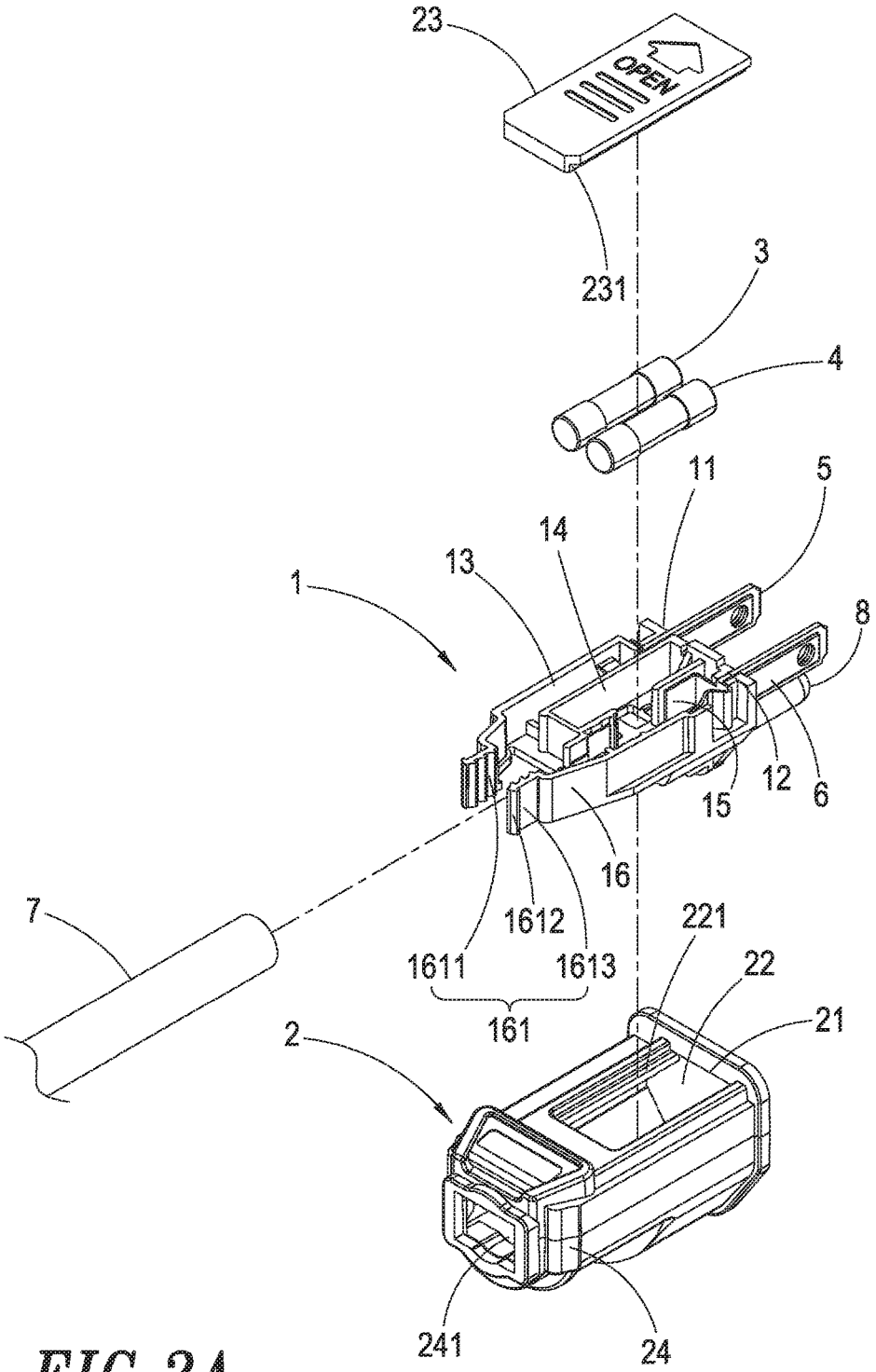
FIG. 3A shows a stereo structural disassembly view for a second embodiment of the plug structure according to the present invention.
Figure 3B:
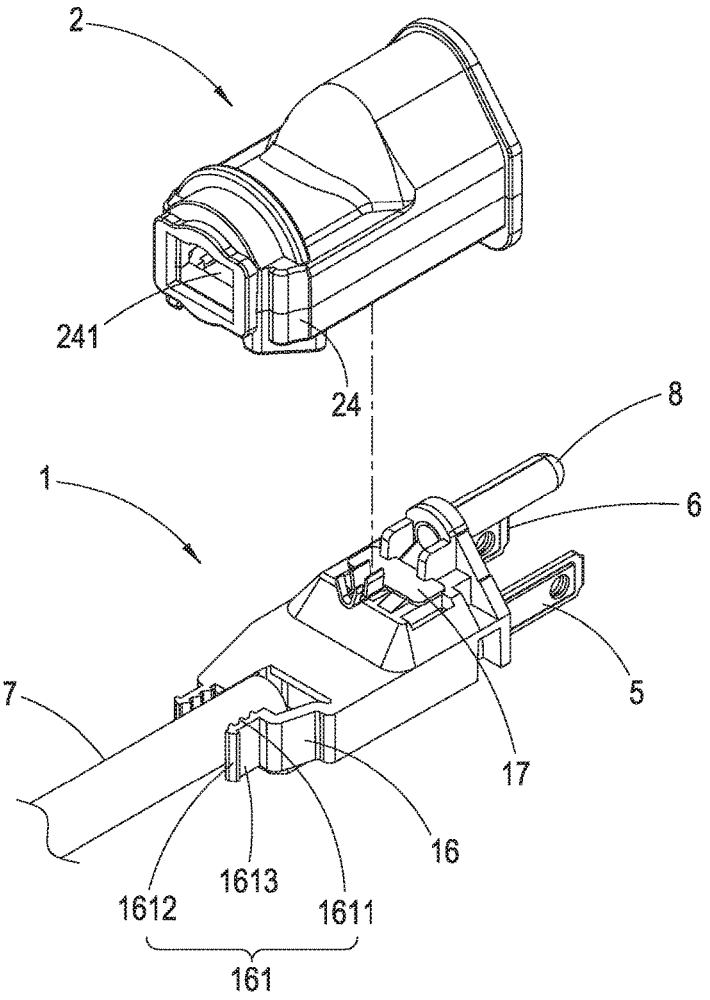
FIG. 3B shows a stereo structural disassembly view observed from another angle for the second embodiment of the plug structure according to the present invention.
Figure 3C:
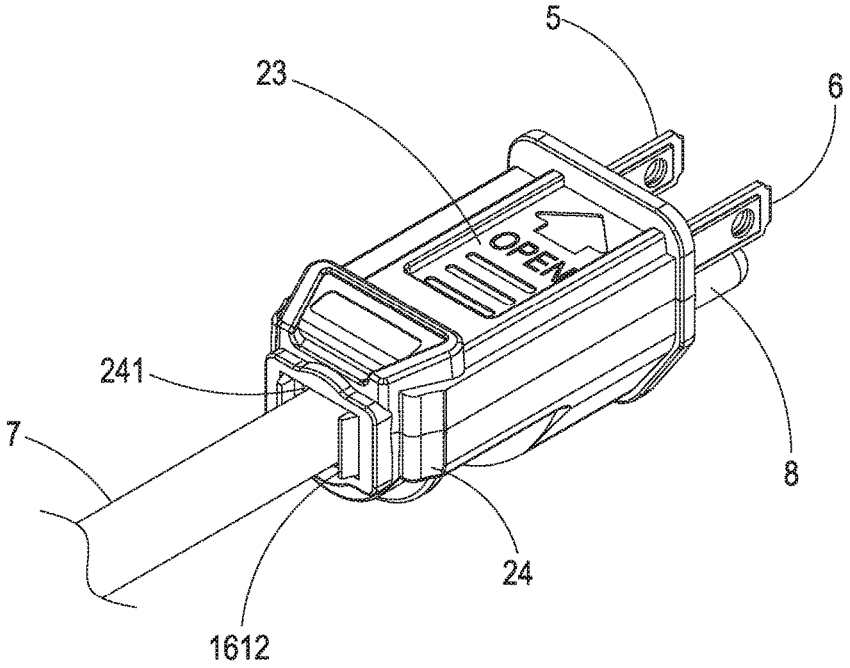
FIG. 3C shows a stereo structural assembly view for the second embodiment of the plug structure according to the present invention.

Furthermore, as shown in FIGS. 3A-3C, the present invention may be also applied to a triple-plugged structure, in which the bottom end of the seat body 1 further includes a plug connection end 17 which can be insertion installed with a ground line conductive terminal 8, so the electric power line 7 may also extend out electric power cords and electrically connect to the ground line conductive terminal 8.

In comparison with other conventional technologies, the plug structure according to the present invention provides the following advantages:

(1) the plug structure according to the present invention allows to design an electric power plug internally installed with a replaceable fuse and further configured with a tight pressure mechanism therein for the connection to an electric power line such that the electric power line can not be easily pulled out from the rear end of the electric power plug;

(2) the present invention further features a structure enabling convenient fuse replacement, so that, when the fuse is melted and broken, the user may directly take out the backup fuse for replacement by himself/herself thus saving time required for purchasing fuses.

It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A plug structure, comprising:

a seat body, in which two slot-shaped plug connection holes are formed at the front end thereof, and a first line-guiding groove, a fuse backup groove and a second line-guiding groove are formed by at least two separation boards at the rear side the two plug connection holes, wherein the rear side of the seat body backwardly and slantingly extends out two opposite guiding plates, with the front end of each guiding plate retracts and further extending out a contraction plate, and the front end on the outer surface of the contraction plate protrudes towards one side to set up a blocker, a recess is formed at the outer surface of the contraction plate between the front retracted part of the guiding plate and the blocker, and a zigzag tooth-wise pattern in configured on the inner surface of the contraction plate;

a backup fuse, placed within the first line-guiding groove;

a main fuse, placed within the second line-guiding groove;

a central line conductive plate, inserted into the plug connection hole in front of the first line-guiding groove;

a fire line conductive plate, inserted into the plug connection hole in front of the second line-guiding groove, in which the rear end of the fire line conductive plate is electrically connected to one end of the main fuse;

an electric power line, allowed to penetrate and be fixed between the two opposite guiding plates, power cords extend from the electric power line and respectively penetrate through the first line-guiding groove and the second line-guiding groove thereby respectively electrically connecting to the tail end of the central line conductive plate and the other end of the main fuse;

a housing, internally including a hollow accommodation space, in which a front end and a top end of the housing respectively have a front end opening and a top end opening communicatively connected to the hollow accommodation space, an inner rim of the top end opening has a slide track, and the inner rim of the top end opening can be further combined with a cover board having a slide block which can slide forwards and backwards along the slide track in the inner rim of the top end opening; besides, the rear end of the housing includes a retracted opening portion having a rear end opening, an inner side of the retracted opening portion has a guiding plane, and the front end of the guiding plane includes at least an abutting mass protruding from the inner side of the retracted opening portion; and wherein the housing can be placed in a sleeve towards the seat body from the electric power line, the blocker of the contraction plate slides towards the rear end opening along the guiding plane of the retracted opening portion, and, after the contraction plate extends out from the rear end opening, the blocker of the contraction plate can be fixedly positioned inside the recess of the guiding plate and the contraction plates on the two sides of the electric power line can be squeezed and pressed inwards, thereby allowing the zigzag tooth-wise patterns on the inner surfaces of the two contraction plates to be tightly pressed on the surface of the electric power line.

2. The plug structure according to claim 1, wherein the top end opening of the housing corresponds to the locations of the fuse backup groove and the second line-guiding groove.

3. The plug structure according to claim 1, wherein the electric power cord in the electric power line is electrically connected to the main fuse via a conductive copper plate.

4. The plug structure according to claim 1, wherein the bottom of the seat body is further configured with a plug connection end, and a ground line conductive terminal can be inserted and installed on the plug connection end such that the electric power cord can also extend out from the electric power line for electric connections to the ground line conductive terminal.

* * * * *